US006637713B1

(12) United States Patent
Kleve et al.

(10) Patent No.: US 6,637,713 B1
(45) Date of Patent: Oct. 28, 2003

(54) LOG SUPPORTING APPARATUS

(76) Inventors: Robert Bruce Kleve, 23056 Warner St., Farmington, MI (US) 48336; Mark Jones, 707 E. Reagan Pkwy., #166, Medina, OH (US) 44256

( * ) Notice: Subject to any disclaimer, the term of this patent is extended or adjusted under 35 U.S.C. 154(b) by 0 days.

(21) Appl. No.: 09/915,250

(22) Filed: Jul. 26, 2001

(51) Int. Cl.[7] ..... F23H 13/00
(52) U.S. Cl. ..... 248/440.1; 126/540; 126/152 B
(58) Field of Search ..... 248/519, 516, 248/512, 440.1, 525, 527; 126/152 B, 152 A, 540

(56) References Cited

U.S. PATENT DOCUMENTS 892,181 A * 6/1908 Peterson
952,655 A * 3/1910 Wagner
1,766,170 A * 6/1930 Goldwood
2,875,968 A * 3/1959 Ekola ..... 248/48
3,661,349 A * 5/1972 De Vries ..... 248/46
3,715,095 A * 2/1973 Drablowski ..... 248/46
4,239,198 A * 12/1980 Trupp ..... 269/156
4,825,586 A * 5/1989 Coppedge ..... 47/40.5
5,035,438 A * 7/1991 Cronquist ..... 280/79.5
D343,450 S * 1/1994 Doty ..... D23/410
5,465,529 A * 11/1995 Park ..... 47/40.5
6,405,724 B1 * 6/2002 Richard ..... 126/540

* cited by examiner

*Primary Examiner*—Anita King
*Assistant Examiner*—Steven Marsh
(74) *Attorney, Agent, or Firm*—Robert E. Kleve

(57) ABSTRACT

The invention comprises a log supporting apparatus for a fireplace having three supporting legs converging upward at an angle toward one another to form a tripod. The apparatus has an upper and lower bracket fitted within the confines of the legs with the legs at 120 degree intervals about a circle and with the brackets having pins projecting outward into bores in the legs to support the legs and brackets with the legs at their inclined angle. The lower bracket is spaced above the bottom of the legs and acts to support the bottoms of the logs with the upper portions of the logs resting at an inclined angle toward one another against the upper bracket whereby ignitable material may be placed beneath the logs and the logs may be easily burned.

3 Claims, 3 Drawing Sheets

LOG SUPPORTING APPARATUS

BACKGROUND OF INVENTION

The invention relates to log holding or supporting apparatus, more particularly, the invention relates to log supporting apparatus for supporting logs and the like in a fireplace for burning.

It is an object of the invention to provide a novel log supporting apparatus having triangular teepee-like shape for supporting logs for burning in a fireplace in a partly upright inclined position toward one another.

It is another object of the invention to provide a novel log supporting apparatus for supporting logs in a partly upright position inclined toward one another in a fireplace for easier or better burning of the logs in the fireplace.

It is a further object of the invention to provide a novel apparatus for supporting logs in a partly upright position inclined towards one another.

Further objects and advantages of the invention will become apparent as the description proceeds and when taken in conjunction with the accompanying drawing wherein:

DESCRIPTION OF PREFERRED EMBODIMENT

Briefly stated, the invention comprises a log supporting apparatus having three supporting legs converging upward at an angle toward one another to form a tripod. The apparatus has an upper and lower bracket within the confines of the legs, with the upper bracket smaller than the lower bracket, and with three pins projecting outward, receivable in eyelets in the upper portions of the legs. The lower bracket is adjacent the inside of the intermediate portion of the legs with three pins projecting outward receivable and eyelets in the legs intermediate the height of the legs. The upper and intermediate brackets, by their cooperative engagement of their pins with the eyelets of the legs support one another. The apparatus is adapted to be placed in a fireplace or firepit with the intermediate bracket acting to support the bottom of the logs with the upper portions of the logs in an inclined position between the legs and against the bracket.

Figure 1:
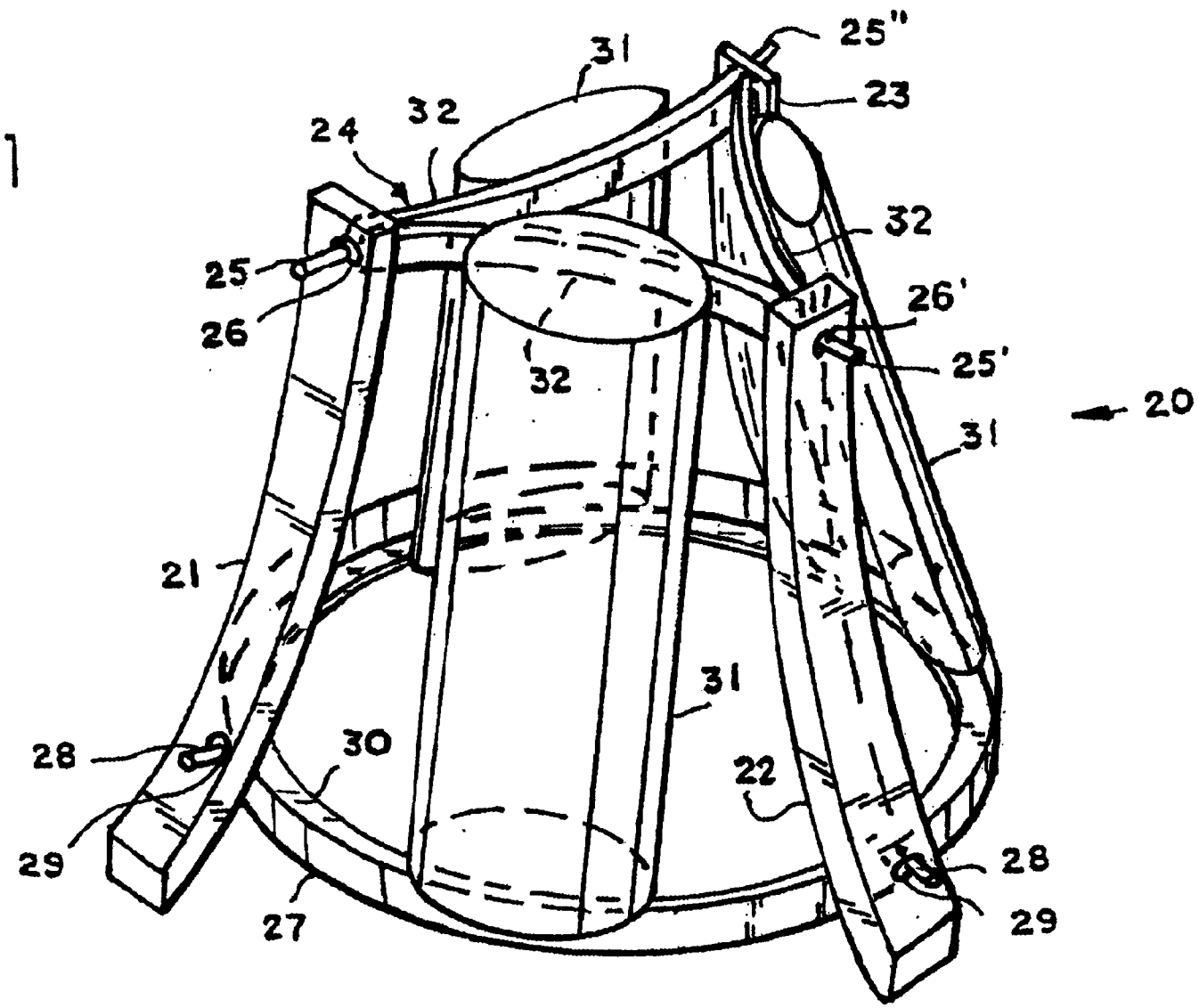
FIG. 1 is a perspective of the log supporting apparatus invention.
Figure 2:
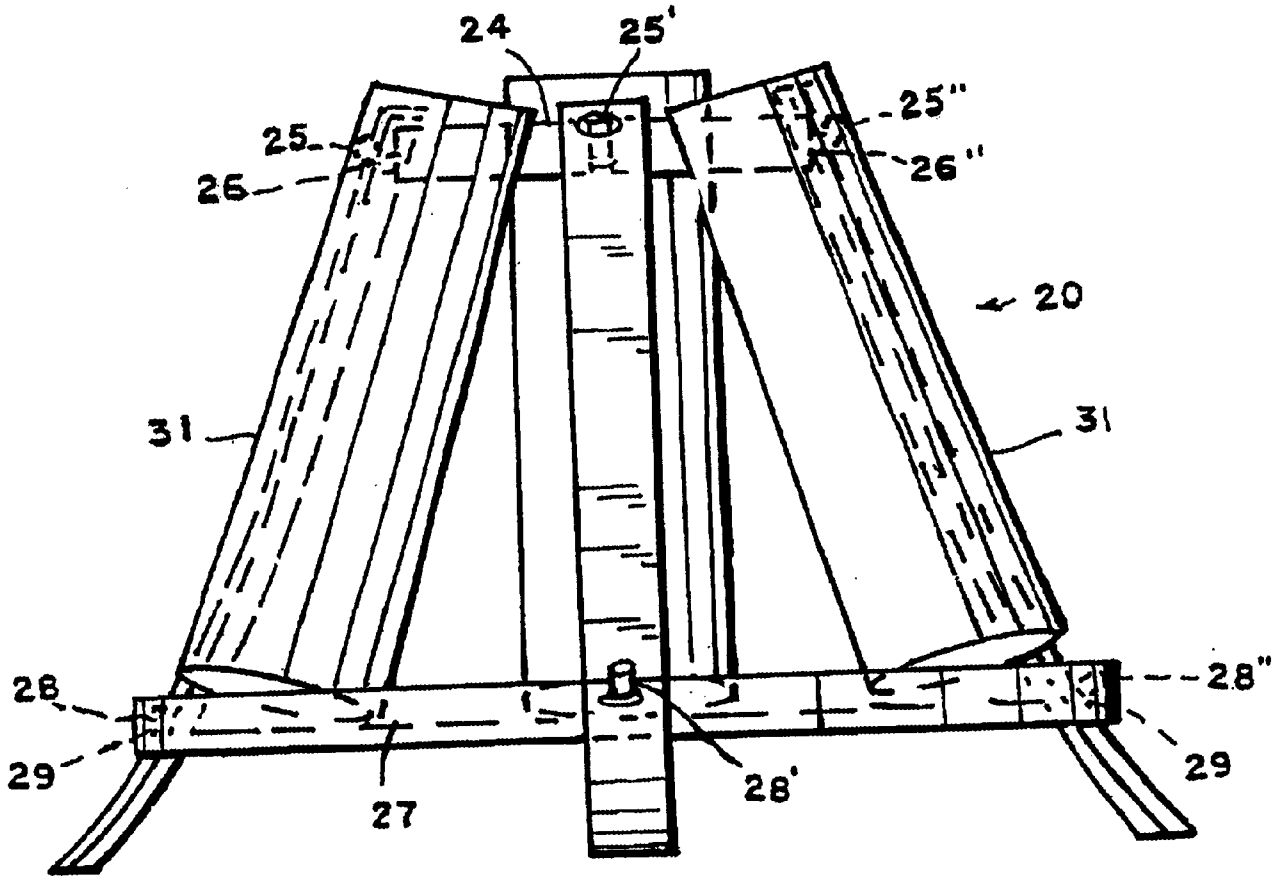
FIG. 2 is a side elevational view of the log supporting apparatus invention.
Figure 3:
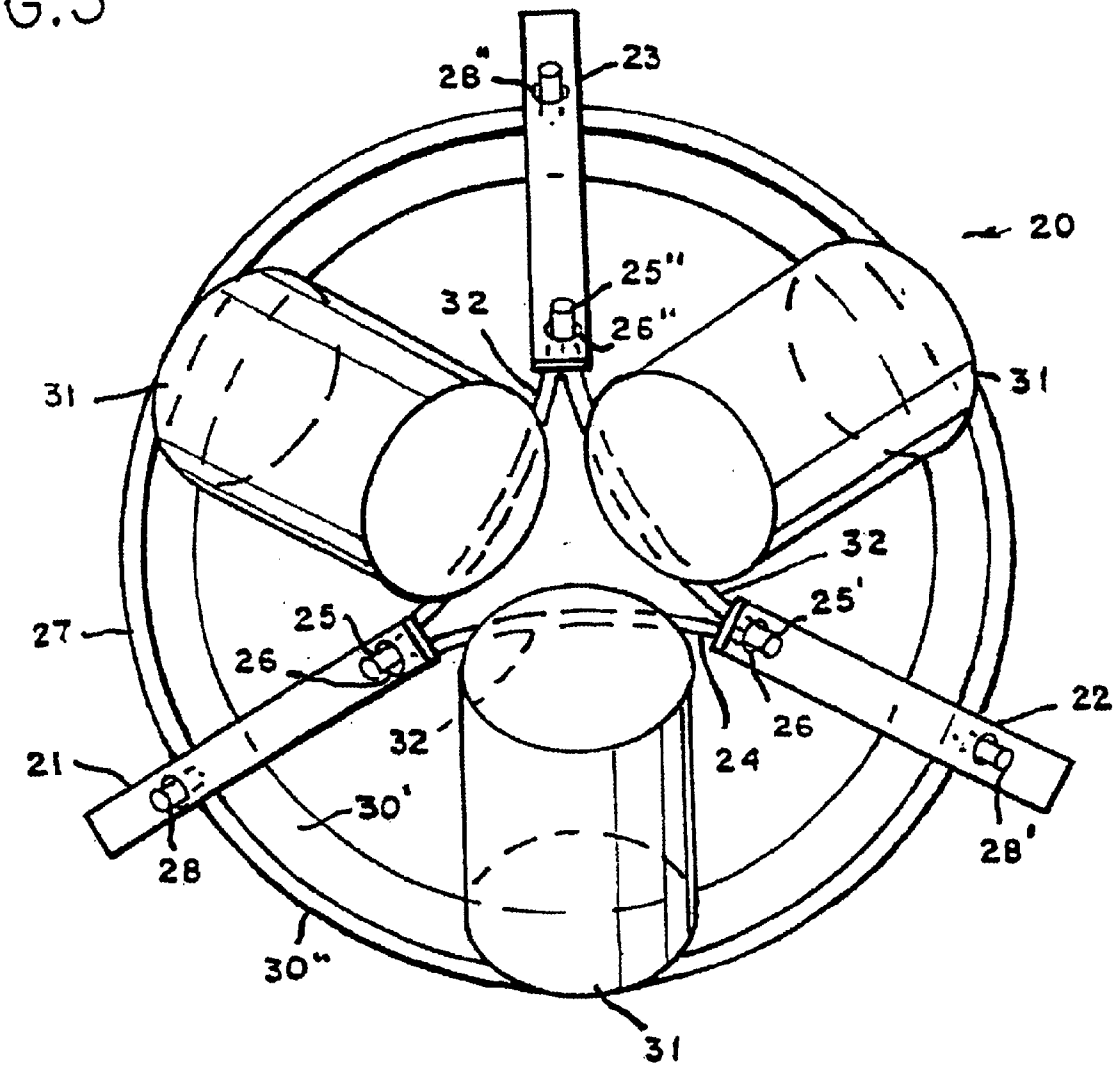
FIG. 3 is a top plan view of the log supporting apparatus invention.

Referring more particularly to the drawings, in FIG. 1, the log supporting apparatus is illustrated having three supporting legs, 21, 22, and 23. An upper bracket 24 is placed within the confines of the upper portion of the legs. The bracket has three projecting pins 25, 25', 25" at 120-degree intervals about the bracket projecting outward and receivable in eyelets 26, 26', 26" in the upper ends of the legs. These detachably support the upper ends of the legs in their inclined upward position and also act to cooperatively detachably support the upper bracket 24 in its position within the confines of the upper end of the legs.

A second lower intermediate bracket 27 is positioned within the confines of the legs at a height intermediate the height of the legs. The second bracket also has projecting pins, 28, 28', 28" at 120-degree intervals about the circumference of the bracket. The legs 21,22,23 also have lower eyelets 29, 29'; 29" intermediate their height to detachably receive the pins 28, 28', 28" of the intermediate bracket.

The pins of both brackets cooperate with the eyelets of the legs to lock the brackets and legs in their position as shown in the drawings, when the legs are resting on the ground surface such as a fireplace.

The intermediate bracket 27 has a channel 30 formed therein about its circumference. The channel 30 is formed by a annular horizontal ring portion 30', and a circular vertical circumferential ring portion 30". The upper bracket 24 has three concave portions 32.

When the apparatus is placed in a fireplace for use in burning logs 31, the legs of the apparatus will rest upon the ground surface 33 of the fireplace. The logs 31, for burning in the fireplace with be placed on the apparatus by placing the bottoms of the logs 31, to rest on the channel 30 of the bracket. The upper ends of the logs will incline inwardly toward one another to rest against the concave portions 32 of the upper bracket. The concave portions 32 of the upper bracket are closer in radius to one another than the radius of the lower channel 30, so as to enable the logs to be inclined towards one another when the logs are so positioned.

The bottom of the logs by resting on the channel 30 of the lower bracket, are spaced above the surface 33 of the fireplace, so that paper and other ignitable material may be easily placed beneath the logs and the beneath the channel 30, for easier igniting of the logs on the apparatus. Additional logs may be inclined against the upper bracket with their bottoms resting outward upon the channel 30 of the intermediate bracket.

The legs, as an alternative, may have portions bow inwardly to meet and connect to one another at locations where the brackets were as a replacement for the brackets.

Thus it will be seen the a novel log supporting invention has been provided which enables the logs to be placed in an upward inclined position towards one another with their bottoms spaced above the ground for improved burning of the logs in the fireplace.

It will be obvious that various changes and departures may be made to the invention without departing from the spirit and scope thereof, and accordingly, it is not intended that the invention be limited to that specifically described in the specification or as illustrated in the drawing, but only as set forth in the appended claims, wherein:

What is claimed is:

1. A log supporting apparatus comprising three elongated legs each having upper ends, lower intermediate portions and lower ends; an upper and lower intermediate bracket; said brackets each having mounting pins projecting radially outward from their respective bracket at 120 degree intervals about a circle; said legs each having bores at their upper ends and lower intermediate portions to receive said pins of said brackets to detachably connect the brackets to the legs, whereby the legs are supported by the brackets in an upward extending position at 120 degree intervals about a circle; said upper brackets having portions closer to one another than said lower bracket, so that the apparatus may be placed in a fireplace and logs for burning having upper and lower ends may be placed on the apparatus with their lower ends resting on the lower-intermediate bracket and their upper ends resting on the closer portions of the upper bracket, so as to be inclined toward one another; said lower intermediate bracket having an annular channel portion with bottom and outer inclined sides for receiving the lower ends of the logs to facilitate supporting the lower ends of the logs, and wherein said lower intermediate bracket is spaced above said lower ends of said legs to facilitate placement of ignitable material within the confines of the apparatus and beneath the lower ends of the logs for easier igniting of the logs.

2. A log supporting apparatus for supporting logs in a fireplace comprising three elongated legs each having upper and lower ends and intermediate portions; an upper bracket and a lower bracket; said upper bracket having means for supporting the three legs at their upper ends at spaced 120 degree intervals circumferentially about a center axis; said lower bracket having means supporting the lower portions of the three legs at spaced 120 degree intervals circumferentially about the center axis with the legs having lower ends extending below the lower bracket for engagement with a supporting surface to support the apparatus;

said upper bracket having concave outer surfaces between said legs for detachably receiving and supporting the logs at their upper ends, circumferentially about the upper bracket, at 120 degree intervals and outside the confines of the bracket; said lower bracket means having outer surface means between said legs for receiving and supporting the lower ends of the logs between the legs circumferentially at 120 degree intervals about the lower bracket, with the lower ends of the logs spaced radially further outward than the upper ends of the logs and inclined inward and upward toward one another and spaced above the lower ends of the legs;

so that the logs may rest inclined toward one another, with the lower ends of the logs spaced above the bottoms of the legs of the apparatus so that igniting material may be placed centrally in the apparatus beneath the lower ends of the logs for igniting the logs on the apparatus, with the apparatus in a fireplace for burning of the logs in the fireplace.

3. A tepee log supporting apparatus for supporting logs in a tepee conformation for burning in a fireplace with said logs having upper and lower ends, said tepee apparatus comprising at least three elongated legs each having upper and lower ends with said legs spaced at intervals about a vertical axis and converging upward toward one another, a central upper support means mounted to said legs at their upper ends to hold said legs in fixed relation to one another in a circle with their upper ends converging toward said support means, said upper support means having concave outer surfaces between the upper ends of the legs facing radially outward from the vertical axis for receiving and supporting the logs at their upper ends between the legs at locations circumferentially about the center axis with the logs converging upward toward one another between the legs and toward the center axis of the apparatus for the burning of logs in the fireplace.

* * * * *